US005223805A

United States Patent [19]

Talcott et al.

[11] Patent Number: 5,223,805

[45] Date of Patent: Jun. 29, 1993

[54] COMMON NODE REACTANCE NETWORK FOR A BROADBAND CROSS BEAM LUMPED-ELEMENT CIRCULATOR

[75] Inventors: Mark A. Talcott, Torrance; Kim Poulson, Ridgecrest, both of Calif.; Om Gandhi, Salt Lake City, Utah

[73] Assignee: Hughes Aircraft Company, Los Angeles, Calif.

[21] Appl. No.: 775,882

[22] Filed: Oct. 11, 1991

[51] Int. Cl.[5] ..... H01P 1/387

[52] U.S. Cl. ..... 333/1.1; 333/238

[58] Field of Search ..... 333/1.1

[56] References Cited

U.S. PATENT DOCUMENTS 3,551,853 12/1970 Konishi ..... 333/1.1

3,836,874 9/1974 Maeda et al. ..... 333/1.1

*Primary Examiner*—Paul Gensler

*Attorney, Agent, or Firm*—L. A. Alkov; W. K. Denson-Low

[57] ABSTRACT

A microwave circulator circuit having a multiple port lumped-element circulator, and a common node reactance network for coupling the lumped element circulator to the common ground plane of the microwave circuit with which the circulator circuit is utilized.

3 Claims, 5 Drawing Sheets

COMMON NODE REACTANCE NETWORK FOR A BROADBAND CROSS BEAM LUMPED-ELEMENT CIRCULATOR

BACKGROUND OF THE INVENTION

The subject invention is generally directed to multiple port power directing circuits known as circulator circuits, and is directed more particularly to a relatively broad band lumped-element circulator circuit.

Circulator circuits are commonly utilized in microwave systems for directing microwave power between the components of a microwave system. For example, in radar systems, circulators are used to couple a transmission signal to the radiating antenna and to direct any signals that are received by the same antenna to the receiver while also maintaining isolation between both functions.

Present circulators used in microwave integrated circuits for microwave frequency operation include ferrite microstrip designs. A consideration with ferrite microstrip designs include size, particularly for phased array modules.

Known circulators also include those known as "lumped-element" circulators which have reduced size, relative to ferrite microstrip circulators, at microwave frequencies. However, the operating bandwidth of known lumped-element circulator designs at microwave frequencies are significantly less than that of ferrite microstrip circulators.

The following references disclose microstrip circulators and lumped-element circulators:

1. "On Stripline Y-Circulation at UHF," H. Bosma, *IEEE Transactions on Microwave Theory & Tech.*, Vol. MTT-12, pp 61–72, January 1964.

2. "Lumped Element Y Circulator," Y. Konishi, *IEEE Transactions on Microwave Theory & Tech.*, Vol. MTT-13, pp 852–864, November 1965.

3. "Resonance Isolator and Y-Circulator with Lumped-Elements at VHF," J. Deutsch and B. Wiesser, *IEEE-Transactions on Magnetics*, Vol. MAG-2, pp 278–282, September 1966.

4. "A Compact Broad-Band Thin-Film Lumped-Element L-Band Circulator," R. H. Knerr, *IEEE Transactions on Microwave Theory & Tech.*, Vol. MTT-18, pp 1100–1108, December 1970.

5. "An Improved Equivalent Circuit for the Thin-Film Lumped-Element Circulator," R. H. Knerr, *IEEE Transactions on Microwave Theory & Tech.*, Vol. MTT-20, pp 446–452, July 1972.

6. "A 4-GHz Lumped-Element Circulator," R.H. Knerr, *IEEE Transactions on Microwave Theory & Tech.*, Vol. MTT-16, pp 150–151, March 1973.

7. "Wideband Operation of Microstrip Circulators," Y. S. Wu and F. J. Rosenbaum, *IEEE Transactions on Microwave Theory & Tech.*, Vol. MTT-22, pp 849–856, October. 1974.

8. "Bidirectional Thin-Film Lumped Element Circulator," M. Kitlinski, *Electronic Letters*, Vol. 10, No. 6, 1974.

9. "The Frequency Behavior of Stripline Circulator Junctions," S. Ayter and Y. Ayasli, *IEEE Transactions on Microwave Theory & Tech.*, Vol. MTT-26, pp 197–202, March 1978.

10. "Broad-Band Stripline Circulators Based on YIG and Li-Ferrite Single Crystals," E. Schloemann and R. E. Blight, *IEEE Transactions on Microwave Theory & Tech.*, Vol. MTT-34, pp 1394–1400, Dec. 1986.

11. "Circulators for Microwave and Millimeter Wave Integrated Circuits," E. F. Schloemann, *Proceedings of the IEEE*, Vol. 76, pp 188–200, Feb. 1988.

12. "Multiport Lumped Element Circulators," M. Kitlinski, Technical University of Gdansk, Telecommunications Institute 80-852 Gdansk, Majakowskiego 11/12, Poland.

SUMMARY OF THE INVENTION

It would therefore be an advantage to provide a microwave circulator circuit having reduced size and relatively broad bandwidth.

Another advantage would be to provide a relatively broad band microwave circulator utilizing known lumped-element circulator designs.

The foregoing and other advantages are provided by the invention in a circulator circuit for use in a microwave circuit that includes a lumped-element circulator and a common node reactance network for coupling the lumpedelement circulator to the common ground plane of the microwave circuit.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
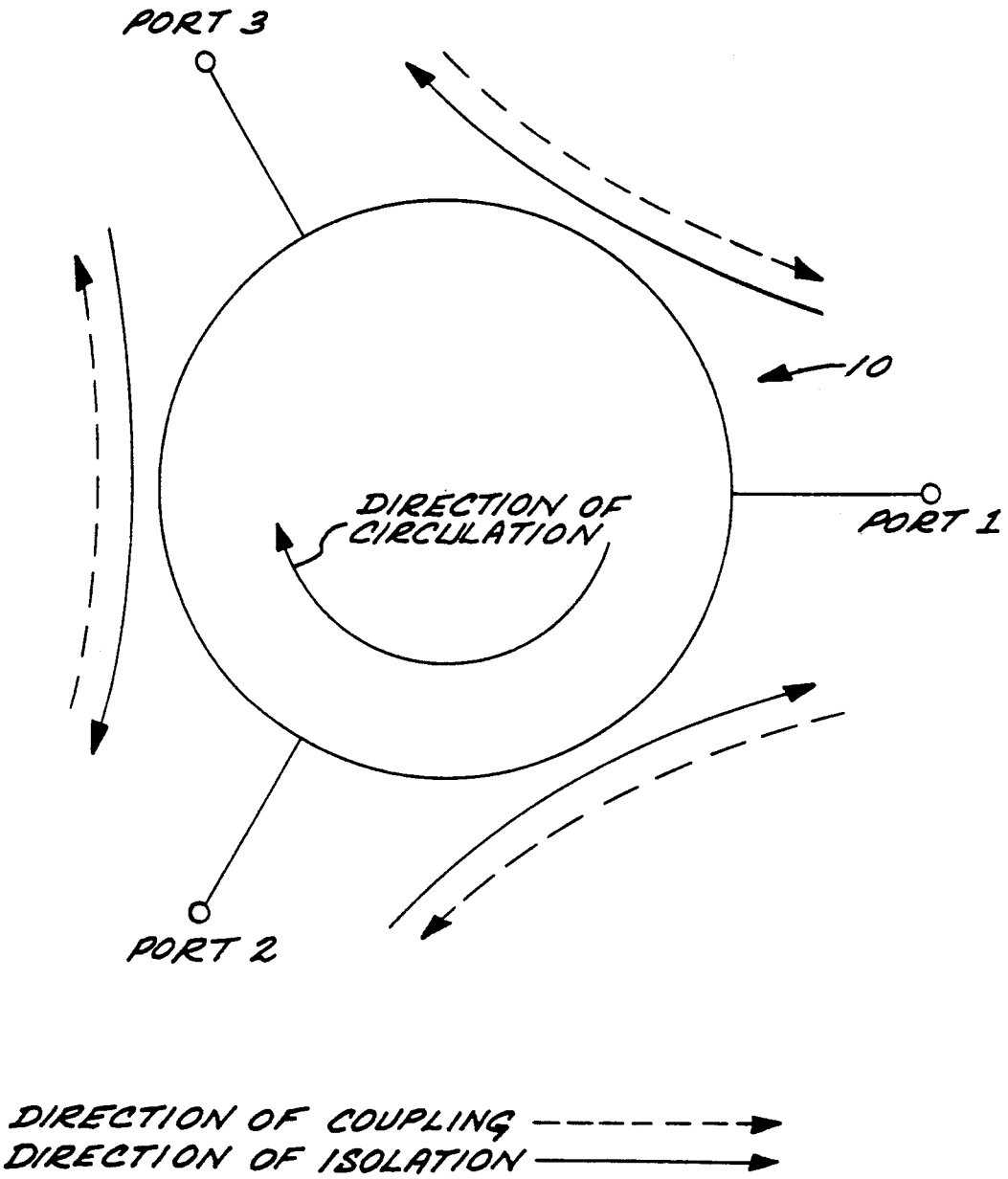
FIG. 1 is a schematic diagram depicting the operation of a circulator circuit.

In the following detailed description and in the several figures of the drawing, like elements are identified with like reference numerals.

Referring now to FIG. 1, shown therein is a schematic representation of the ideal operation of a three port circulator circuit 10. Ideally, the circulator has zero reflection at all ports and zero insertion loss in forward direction. As indicated in FIG. 1, such forward direction is from port 1 to port 2, from port 2 to port 3, and from port 3 to port I. Further, the circulator ideally provides infinite isolation in the reverse direction. As indicated in FIG. 1, that reverse direction is from port 1 to port 3, from port 2 to port 1, and from port 3 to port 2.

Figure 2:
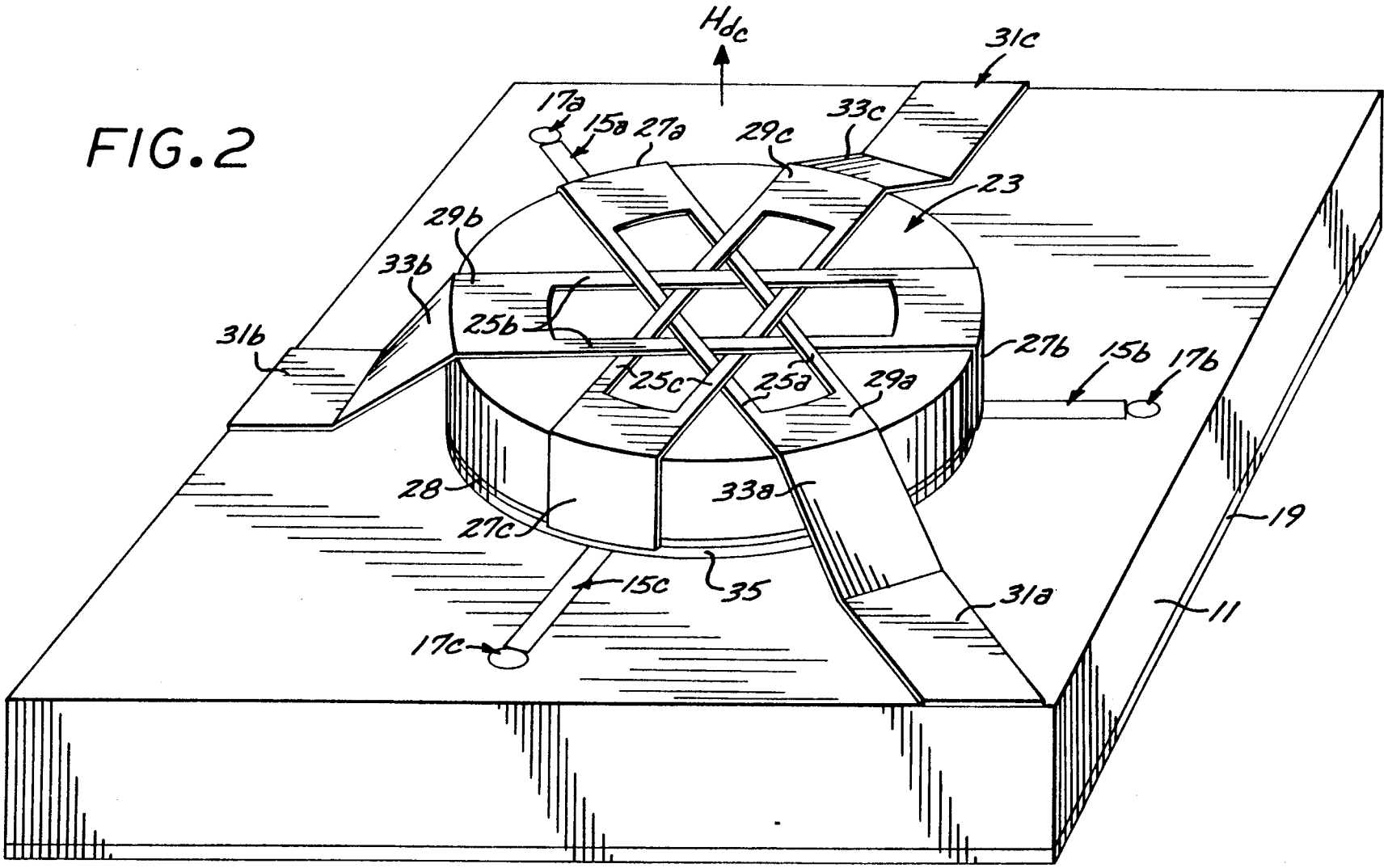
FIGS. 2 and 3 illustrate a first implementation of a circulator circuit in accordance with the invention.
Figure 3:
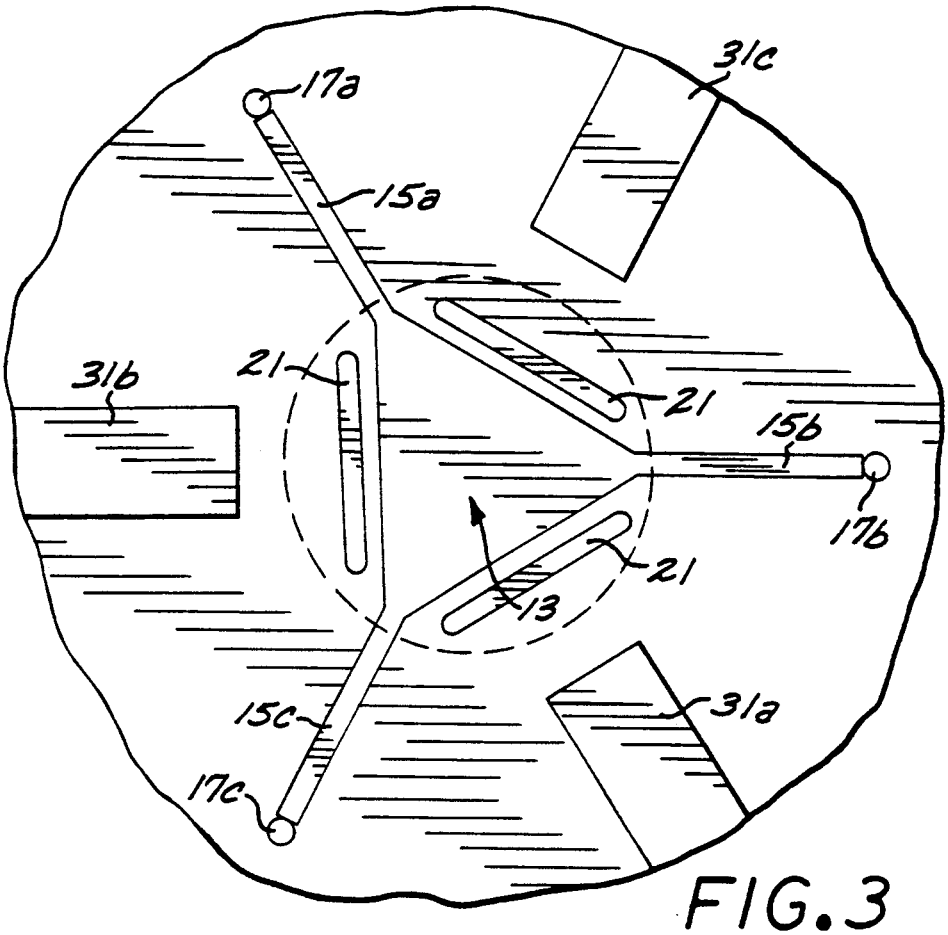

Referring now to FIGS. 2 and 3, shown therein is a implementation of a circulator circuit in accordance with the invention. The circulator circuit includes an alumina substrate 11 that supports a common node reactance circuit and a lumped-element circulator that is coupled to ground via the series resonant circuit.

The series common node reactance circuit includes a parallel plate capacitor and microstrip line inductances. An equilaterally triangularly shaped metallized area 13 formed on the alumina substrate 11 forms the first plate of the capacitor. The second plate of the capacitor is part of the structure comprising the lumped-element circulator and is discussed further below. Microstrip line inductances 15*a*, 15*b*, 15*c* extend radially from the vertices of the metallized area 13 and are uniformly spaced about the metallized area 13. The ends of the inductances are connected to respective grounding pins 17*a*, 17*b*, 17*c* that extend downwardly through the substrate 11 and are electrically connected to a metallized area 19 on the bottom of the substrate 11. The metallized area 19 comprises the ground plane for the microstrip circuitry disposed on the substrate 11.

Supporting ridges 21 are disposed adjacent the respective sides of the metallized area 13 for separating such metallized area from the second plate of the coupling capacitor that comprises a metallized layer 28 formed on the bottom of the structure comprising the lumped-element circulator.

By way of example, the metallized area 13 that comprises the first plate of the coupling capacitor and the microstrip line inductances 15 are formed pursuant to thin film photolithographic techniques, and the supporting ridges 21 comprise regions of developed photoresist.

The lumped-element circulator includes a ferrite disk 23 and three microstrip conductors 25*a*, 25*b*, 25*c* symmetrically deposited on the ferrite disk 23. Each microstrip conductor comprises first and second parallel strips that are commonly connected at each end. To maintain symmetry, the strips of the microstrip conductors are interwoven at the central area of the ferrite disk.

The first ends of the microstrip conductors are connected to respective grounding straps 27*a*, 27*b*, 27*c* that extend down the side of the ferrite disk 23 to the metallization layer 28 formed on the bottom of the ferrite disk 23. The second ends of the microstrip conductors are connected to respective terminating metallization areas 29*a*, 29*b*, 29*c* which are electrically connected to respective 50 ohm microstrip 31*a*, 31*b*, 31*c* via respective bonding strips 33*a*, 33*b*, 33*c*. The interwoven microstrip elements are separated from each other by appropriate dielectric layers (not shown), and the crossing portions of the conductors comprise coupling capacitances between the respective crossing microstrip lines.

The assembly comprising the ferrite disk 23 and the components disposed thereon is bonded onto the substrate 11 by an adhesive layer 35 which further functions as the dielectric between the plates of the parallel plate coupling capacitor that includes the metallization area 13 disposed on the substrate 11 and the metallization layer 28 disposed on the bottom of the ferrite disk 23. As discussed above, the support ridges 21 maintain the separation between the capacitor plates comprising the metallization area 13 formed on the substrate 11 and the metallization layer 28 formed on the bottom of the ferrite disk 23.

The lumped-element circulator further includes a biasing magnet for providing a biasing magnetic field $H_{dc}$.

The conductor and dielectric layers on the top side of the ferrite disk 23 are made with thin-film photolithographic techniques, with several steps being utilized to accomplish the dielectric and conductor crossover areas. The bottom side of the ferrite disk 23 is also metallized using thin-film metallization techniques.

Figure 5:
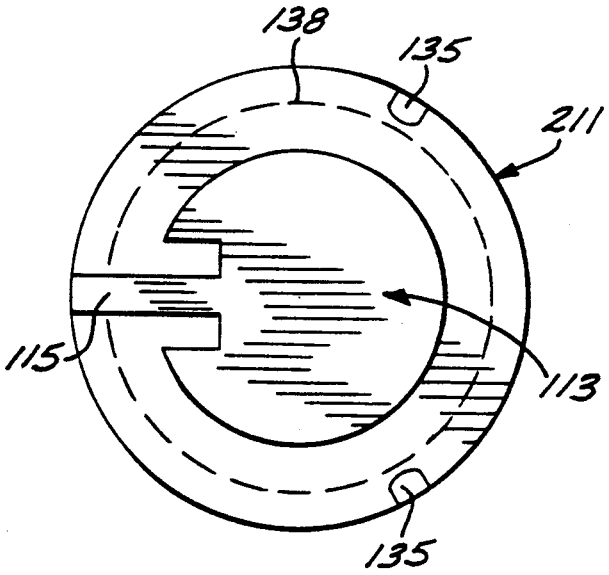
FIGS. 4, 5, and 6 illustrate a second implementation of a circulator circuit in accordance with the invention.
Figure 6:
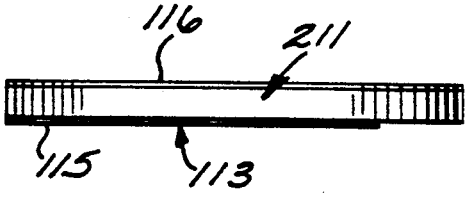
Figure 4:
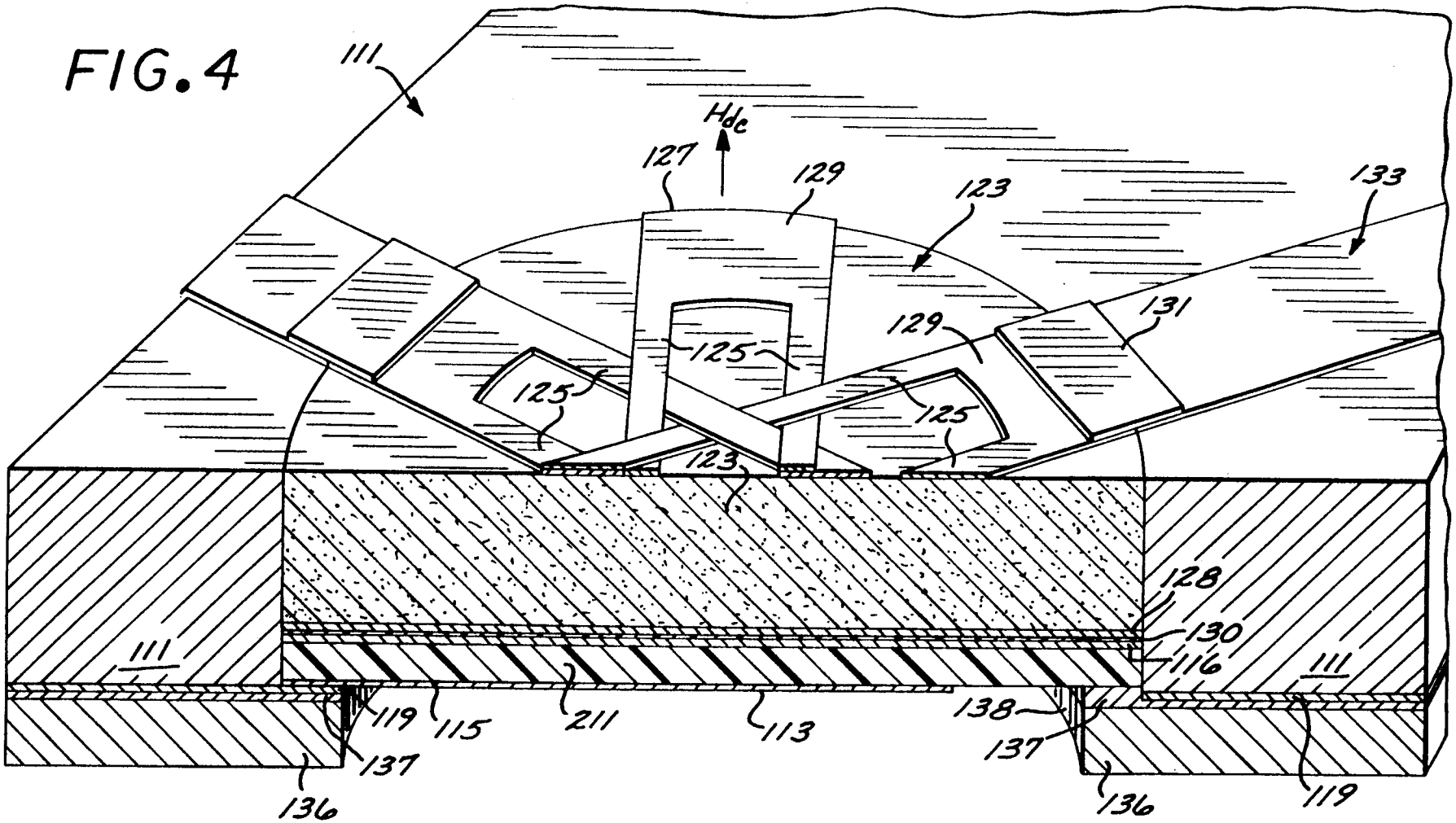

Referring now to FIGS. 4, 5 and 6, shown therein is a further implementation of a circulator circuit in accordance with the invention. The circulator assembly which includes a common node reactance circuit and a lumpedelement circulator are inserted in a bore formed in a substrate 111 and are supported by a metal carrier 136.

The common node reactance circuit includes a microstrip parallel plate capacitor and a microstrip line inductance. A metallized notched circular area 113 comprising the first plate of the capacitor is formed on the bottom side of a dielectric disk 211. A microstrip line inductance 115 extends radially outward from the notch of the metallized notched circular area 113 to the edge of the dielectric disk 211. The top side of the dielectric disk 211 has a metallization layer 116 comprising the second plate of the capacitor of the common node reactance circuit.

The top side of dielectric disk 211 is metallized using thin-film metallization techniques, and the metallization pattern on the bottom side of dielectric disk 211 is formed with thin-film photolithographic techniques.

The lumped-element circulator includes a ferrite disk 123 and three microstrip conductors 125 symmetrically deposited on the ferrite disk 123. Each microstrip conductor comprises first and second parallel strips that are commonly connected at each end. To maintain symmetry, the strips of microstrip conductors are interwoven at the central area of the ferrite disk. The first ends of the microstrip conductors are connected to respective grounding straps 127 that extend down the side of the ferrite disk 123 to a metallization layer 128 formed on the bottom of the bottom of the ferrite disk 123. The second ends of the microstrip conductors are connected to respective terminating metallization areas 129 which are electrically connected to respective 50 ohm microstrips 133 via respective bonding strips 131. The interwoven microstrip elements are separated from each other by appropriate dielectric layers (not shown), and the crossing portions of the conductors comprise coupling capacitances between the respective crossing microstrip lines.

The conductor and dielectric layers on the top side of the ferrite disk 123 are made with thin-film photolithographic techniques, with several steps being utilized to accomplish the dielectric and conductor crossover areas. The bottom side of the ferrite disk 123 is metallized using thin-film metallization techniques.

The lumped-element circulator circuit and the common node reactance circuit are jointed using conductive epoxy. In particular, the metallization layer 128 of the ferrite disk 123 is attached to the top side metallization layer 116 of the dielectric disk 211 with a conductive epoxy layer 130. The assembly comprising the common node reactance circuit and the lumped-element circulator circuit are aligned within the bore of the alumina substrate 111 and attached to the metal carrier 136 using a eutectic solder layer 137. The diameter of the bore 138 in the metal carrier allows metallization tabs 135 and the end of microstrip line inductance 115 on the bottom side of dielectric disk 211 to be attached to the metal carrier 136 by the solder layer 137. This attachment electrically connects the microstrip line inductance 115 to the common ground plane 119.

The lumped-element circulator further includes a biasing magnet for providing a biasing magnetic field $H_{dc}$.

Figure 7:
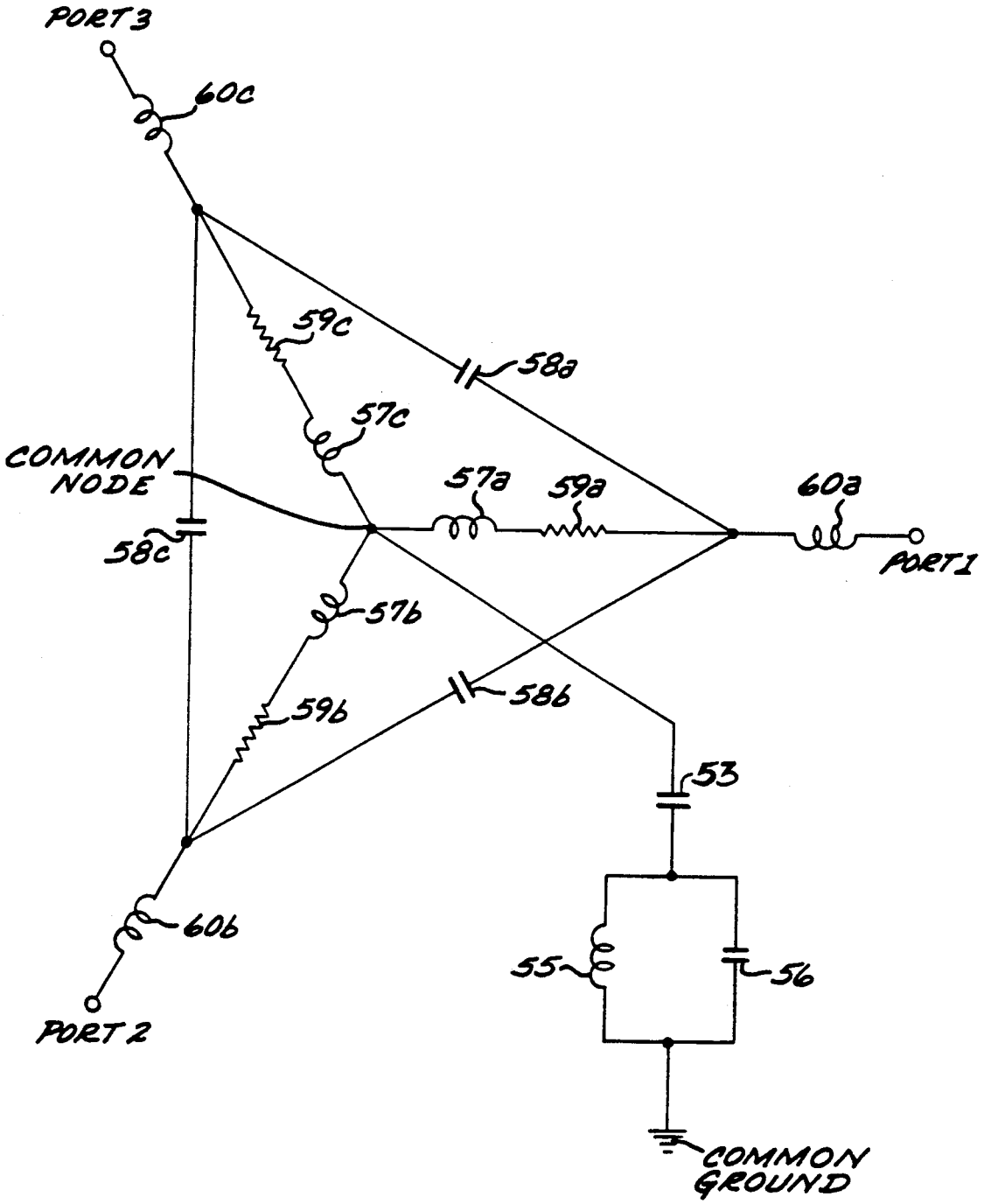
FIG. 7 is a schematic diagram illustrating an equivalent circuit of the circulator circuit illustrated in FIGS. 2 and 3, and the circulator circuit in FIGS. 4, 5, and 6.

Referring now to FIG. 7, shown therein is a circuit schematic of an equivalent circuit of the broad band circulator circuit of the invention. The lumped-element circulator is represented by the lumped-element circulator equivalent circuit elements 57, 58, 59, and 60. The inductances 57 represent the parallel split microstrip effective loaded inductances, and the capacitors 58 are the equivalent coupling capacitances formed by the central microstrip crossings. The inductances 60 are the end tab inductances and the resistors 59 represent the equivalent microstrip resistance losses.

The coupling capacitor and series inductance of the common node reactance circuit are represented by a capacitor 53 that is in series with an inductor 55. A capacitor 56 in parallel with the inductor 55 represents stray capacitance.

To understand the operation of the invention, a brief description of the lumped-element circulator will be presented. To understand how circulation, forward coupling and reverse isolation is achieved in the lumped-element circulator, ferrite properties need to be considered. Under the influence of a DC biasing magnetic field $H_{dc}$ an electron in a ferrite will tend to align its axis of angular rotation in the direction of the biasing magnetic field. If a disturbing magnetic field is applied perpendicular to the direction of the biasing field, the electron will precess about its alignment axis until the damping mechanisms of the ferrite establish an equilibrium precession orbit. In the case of two oppositely directed, circularly polarized fields, the field polarized in the direction of the precession angle will experience interaction with the ferrite material properties and the oppositely polarized field will have little or no interaction. The material interactions produce separate resonant frequencies for the two oppositely directed, circularly polarized magnetic fields. The separate resonant frequencies will cause a rotation of the linear field that results from the combination of the two counter rotating, circularly polarized fields.

The magnetically biased ferrite core rotates the incoming (i.e., disturbing) magnetic field such that the magnetic field lines parallel (i.e., isolate) one of the lumped-element circulator microstrips and cross (i.e., couple) the remaining microstrips. The lumped-element circular circulation is achieved by a non-reciprocal inductive coupling due to the magnetically biased ferrite core of the microstrip coils. For example, a magnetic field incident at port 1 is rotated by the ferrite core, providing maximum magnetic induction between the conductive microstrip coils connected to ports 1 and 2, while maintaining minimum magnetic induction to the conductive microstrip coil connected to port 3. Also, note that the crossing conductor proximity of the lumped-element circulator design allows for tight magnetic coupling between the respective conductive microstrip coils.

In references cited in the preceding background section, it has been demonstrated that the performance of a three port lumped-element circulator may be analyzed by the characteristic eigen values of the equivalent lumpedelement model. The positive and negative rotating eigen values have been shown to be dependent on the ferrite properties and the resonating structure of the interwoven split conductors. The non-rotating eigen value, the bandwidth limiting factor, has been shown to be uniquely controlled by a coupling network that is common to all three conductive coils of the lumped-element circulator. With the addition of the invention, a resonating common node reactance network, increased control is allowed of the non-rotating eigen value.

Set forth below relative to the equivalent circuit of FIG. 7 are circuit values for an illustrative example of a circulator circuit in accordance with the invention for a ferrite disk having a magnetic saturation ($4\pi Ms$) of 3125 gauss, a line width ($\Delta H$) of 150 oe, and a biasing internal field of 2325 oe.

| | |
|---|---|
| Inductances 57: | 0.46 nH |
| Resistors 59: | 1 Ω |
| Capacitances 58: | 0.03 pF |
| Capacitance 53: | 2.13 pF |
| Inductance 55: | 0.214 nH |
| Capacitance 56: | 0.0 pF |
| Inductances 60: | 0.03 nH |

With the foregoing example, at a center frequency of 9.75 GHz, a bandwidth of 7.5 GHz was achieved with isolation greater than or equal to 20 dB and insertion loss less than or equal to 0.5 dB. Relative to performance of known lumped-element circulators, this example of a circulator in accordance with the invention achieves five-fold improvement.

The foregoing has been a disclosure of a circulator circuit that advantageously operates at microwave frequencies with greater than an octave operating bandwidth at a considerably reduced size.

Although the foregoing has been a description and illustration of specific embodiments of the invention, various modifications and changes thereto can be made by persons skilled in the art without departing from the scope and spirit of the invention as defined by the following claims.

What is claimed is:

1. A circulator circuit for use in a microwave circuit having a common ground plane, comprising:

a ferrite disk having first and second parallel sides;

a plurality of microstrip conductors symmetrically disposed on the first of said parallel sides of said ferrite disk, each of said conductors comprising first and second parallel strips commonly connected at each end wherein said strips of microstrip conductors are interwoven at central area of said ferrite disk to maintain symmetry, and each of said conductors having a first end and a second end, the first ends of said conductors comprising ports of the circulator circuit;

a first conductive layer disposed on the second of said parallel sides of side ferrite disk;

means for electrically connecting said second ends of said conductors to said conductive layer;

a second conductive layer dielectrically separated from said first conductive layer, and forming a capacitor with said first conductive layer; and microstrip line inductance means electrically connected between said second conductive layer and to the common ground plane;

wherein said first and second conductive layers are made with thin-film photolithographic techniques.

2. The circulator circuit of claim 1 wherein said second conductive layer and said microstrip line inductance means are disposed on a substrate that supports said ferrite disk.

3. The circulator circuit of claim 1 wherein said second conductance layer and said microstrip line inductance means are disposed on a dielectric disk that is secured to said first conductive layer.

* * * * *